US007982569B2

(12) United States Patent
Saito et al.

(10) Patent No.: US 7,982,569 B2
(45) Date of Patent: Jul. 19, 2011

(54) INDUCTANCE ELEMENT, METHOD FOR MANUFACTURING THE INDUCTANCE ELEMENT, AND SWITCHING POWER SUPPLY USING THE INDUCTANCE ELEMENT

(75) Inventors: Tadao Saito, Yokohama (JP); Kazumi Sakai, Yokohama (JP); Katsuhiko Yamada, Yokohama (JP)

(73) Assignees: Kabushiki Kaisha Toshiba, Tokyo (JP); Toshiba Materials Co., Ltd., Yokohama-shi (JP)

( * ) Notice: Subject to any disclaimer, the term of this patent is extended or adjusted under 35 U.S.C. 154(b) by 0 days.

(21) Appl. No.: 12/766,669

(22) Filed: Apr. 23, 2010

(65) Prior Publication Data

US 2010/0201474 A1 Aug. 12, 2010

Related U.S. Application Data

(63) Continuation of application No. PCT/JP2008/002993, filed on Oct. 22, 2008.

(30) Foreign Application Priority Data

Oct. 24, 2007 (JP) ..... 2007-276635

(51) Int. Cl.
*H01F 27/02* (2006.01)

(52) U.S. Cl. ..... 336/90

(58) Field of Classification Search ..... 336/65, 336/90, 211, 225, 229
See application file for complete search history.

(56) References Cited

U.S. PATENT DOCUMENTS

| | | | | |
|---|---|---|---|---|
| 4,517,522 | A * | 5/1985 | Furrer | 330/10 |
| 4,958,134 | A | 9/1990 | Sawa et al. | |
| 5,935,347 | A * | 8/1999 | Suzuki et al. | 148/121 |
| 6,031,442 | A * | 2/2000 | Nakazawa | 336/96 |

FOREIGN PATENT DOCUMENTS

| | | |
|---|---|---|
| EP | 0306041 | 2/1988 |
| JP | 59-123321 | 8/1984 |
| JP | 64-64311 | 3/1989 |
| JP | 6-21216 | 3/1994 |
| JP | 2001-319814 | 11/2001 |
| WO | WO 2008/132810 | 11/2008 |
| WO | WO 2008/142865 | 11/2008 |

* cited by examiner

*Primary Examiner* — Tuyen Nguyen
(74) *Attorney, Agent, or Firm* — Oblon, Spivak, McClelland, Maier & Neustadt, L.L.P.

(57) ABSTRACT

In one embodiment, an inductance element includes a toroidal core and a bottomed insulating resin case. The bottomed insulating resin case includes a cylindrical outer wall section, a cylindrical inner wall section, a bottom section, an open section and a hollow section. The cylindrical outer wall section has an extending section exceeding the height of the toroidal core. The open section of the insulating resin case is covered with a cover portion having a bent section formed by bending an extending section of the cylindrical outer wall section.

20 Claims, 7 Drawing Sheets

INDUCTANCE ELEMENT, METHOD FOR MANUFACTURING THE INDUCTANCE ELEMENT, AND SWITCHING POWER SUPPLY USING THE INDUCTANCE ELEMENT

CROSS-REFERENCE TO RELATED APPLICATION

This application is continuation of prior International Application No. PCT/JP2008/002993, filed on Oct. 22, 2008 which is based upon and claims the benefit of priority from Japanese Patent Application No. 2007-276635, filed on Oct. 24, 2007; the entire contents of all of which are incorporated herein by reference.

FIELD

Embodiments described herein relate generally to an inductance element, a method for manufacturing an inductance element, and a switching power supply using the inductance element.

BACKGROUND

The noise from a switching power supply mounted on electronic equipment is restricted by classes as represented by the FCCI. There are various causes of generating a noise, and the noise is mainly generated around a semiconductor element which turns on/off a large amount of power. A high-frequency component propagates as the radiated noise through space and causes malfunction of various types of electronic equipment. Therefore, a regulation value is set for each frequency band. The switching power supply is provided with an anti-noise measure for a semiconductor element, mainly a MOS-FET or a diode.

As a typical example of the anti-noise measure for the MOS-FET or the diode, there is an anti-noise measure using a CR snubber or ferrite beads. The anti-noise measure is selected depending on a balance of the effects, cost and mounting space. When the performance is especially taken into consideration, the anti-noise measure using a Co-based amorphous alloy is used mainly as described in JP-B2 2602843 (Patent Registration). Since the Co-based amorphous alloy has excellent magnetic characteristics such as squareness, its noise reducing effect is better than the ferrite beads.

Since the amorphous alloy is different from an insulating ferrite material and has conductivity, a toroidal core using an amorphous alloy ribbon is generally covered entirely with an insulating resin. This insulating resin or an adhesive penetrates between layers of the amorphous alloy ribbon (magnetic ribbon) and applies a stress to the toroidal core by contraction of the resin dried. The toroidal core using the amorphous alloy has a problem that the magnetic characteristics are degraded by the stress associated with the contraction of the resin.

JP-A 11-345714 (KOKAI) and JP-A 2001-319814 (KOKAI) describe a noise suppression element that a core is inserted into a bottomed container, and a lid is fixed to house the core in the container. When the lidded container is used, the problem associated with the contraction of the resin is avoided, and the magnetic characteristics can be suppressed from degrading. But, the lidded container requires that its lid and container body are separately produced and fixed into one body by assembling them. To produce the lid and the container body from a resin material, it is necessary to prepare their independent metal molds depending on their shapes and to perform injection molding of the resin by using the metal molds.

As described above, the lidded container requires the separate metal molds for the lid and the container body, and their preparation has a problem that the burden of the production cost is large. Besides, the noise suppression element described in JP-A 11-345714 (KOKAI) requires a step of inserting the lid into the container body. The noise suppression element described in JP-A 2001-319814 (KOKAI) requires a step of fixing the container body and the lid by welding. Since the noise suppression element using the lidded container requires a step of attaching the lid, it has a problem that it is particularly inferior in mass production of a small element having a diameter of 10 mm or below.

DETAILED DESCRIPTION

In one embodiment, an inductance element includes a bottomed insulating resin case, a toroidal core, and a cover portion. The bottomed insulating resin case includes a cylindrical outer wall section, a cylindrical inner wall section disposed within the cylindrical outer wall section, a bottom section disposed at one ends of the cylindrical outer wall section and the cylindrical inner wall section to close a space between the cylindrical outer wall section and the cylindrical inner wall section, an open section provided at the other ends of the cylindrical outer wall section and the cylindrical inner wall section, and a hollow section provided within the cylindrical inner wall section. The toroidal core is housed between the cylindrical outer wall section and the cylindrical inner wall section of the bottomed insulating resin case. The cover portion covers the open section of the bottomed insulating resin case. The cover portion includes a bent section formed by bending an extending section of the cylindrical outer wall section exceeding a height of the toroidal core toward the cylindrical inner wall section. Alternatively, the cover portion including a first bent section which is formed by bending an extending section of the cylindrical outer wall section exceeding a height of the toroidal core toward the cylindrical inner wall section, and a second bent section which is formed by bending an extending section of the cylindrical inner wall section exceeding a height of the toroidal core toward the cylindrical outer wall section.

In one embodiment, a method for manufacturing an inductance element includes housing a toroidal core into a bottomed insulating resin case, and covering an open section of the bottomed insulating resin case. The open section of the bottomed insulating resin case is covered by pushing a heated metal head against an extending section of a cylindrical outer wall section exceeding a height of the toroidal core to bend the extending section toward a cylindrical inner wall section. Alternatively, the open section of the bottomed insulating resin case is covered by pushing a heated metal head against an extending section of a cylindrical outer wall section exceeding a height of the toroidal core and against an extending section of a cylindrical inner wall section exceeding a height of the toroidal core to bend the extending section of the cylindrical outer wall section toward the cylindrical inner wall section and to bend the extending section of the cylindrical inner wall section toward the cylindrical outer wall section.

Figure 1:
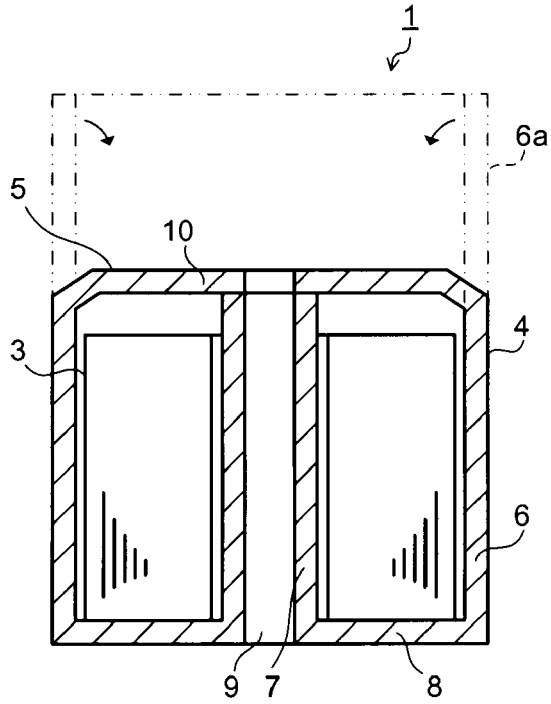
FIG. 1 is a sectional view showing an inductance element according to a first embodiment.
Figure 2:
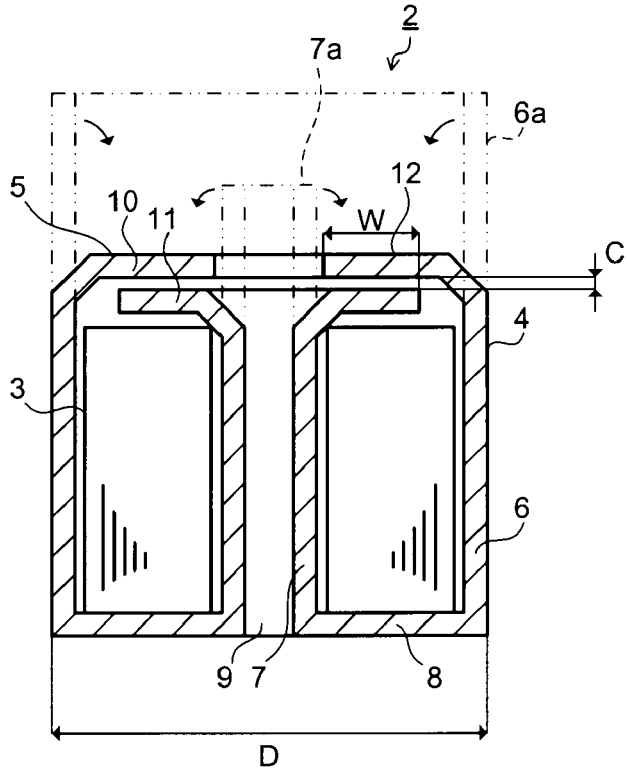
FIG. 2 is a sectional view showing an inductance element according to a second embodiment.

FIG. 1 is a diagram showing an inductance element according to a first embodiment. FIG. 2 is a diagram showing an inductance element according to a second embodiment. Each of inductance elements 1 and 2 shown in FIG. 1 and FIG. 2 includes a toroidal core 3, a bottomed insulating resin case 4 and a cover portion 5.

The toroidal core 3 is not limited to a particular one and may be a soft magnetic body having a toroidal shape (hollow shape). As the soft magnetic body configuring the toroidal core 3, a ferrite, a permalloy, an amorphous alloy, an Fe base alloy having a microcrystalline structure or the like is applied. For the toroidal core 3, various forms of magnetic cores such as a wound body or a stacked body of a soft magnetic alloy ribbon, a sintered body of soft magnetic alloy powder, soft magnetic alloy powder solidified with a resin, etc. can be used.

The soft magnetic material which forms the toroidal core 3 is preferably a Co base amorphous magnetic alloy, an Fe base amorphous magnetic alloy, an Fe base magnetic alloy having a microcrystalline structure, or the like. Since such alloys are readily used to obtain a magnetic alloy ribbon having a thickness of 30 μm or below, they are suitable for a constituent material of the toroidal core 3. By winding or stacking the magnetic alloy ribbon, the toroidal core 3 can be produced easily.

It is preferable that the amorphous alloy which forms the toroidal core 3 has a composition represented by the following formula (1):

$$\text{formula: } (T_{1-a}M_a)_{100-b}X_b \quad (1)$$

where, T denotes at least one element selected from Fe and Co, M denotes at least one element selected from Ti, V, Cr, Mn, Ni, Cu, Zr, Nb, Mo, Ta and W, X denotes at least one element selected from B, Si, C and P, and a and b denote a value satisfying $0 \leqq a \leqq 0.5$, $10 \leqq b \leqq 35$ at %.

The composition ratio of the element T is adjusted depending on the required magnetic characteristics such as a magnetic flux density, an iron loss and the like. The element M is added to control the thermal stability, corrosion resistance and crystallization temperature. The element M is more preferably at least one element selected from Cr, Mn, Zr, Nb and Mo. The contained amount of the element M is 0.5 or less as the value a. If the contained amount of the element M is excessively large, the amount of the element T is decreased relatively, so that the magnetic characteristics of the amorphous magnetic alloy ribbon become low. The value a indicating the contained amount of the element M is preferably in a range of 0.1 to 0.3.

The element X is an element essential to obtain an amorphous alloy. Especially, B is an element effective to provide a magnetic alloy in an amorphous state. Si is an element effective to assist the formation of an amorphous phase and to increase a crystallization temperature. If the added amount of the element X is excessively large, magnetic permeability is decreased or fragility is caused. If the added amount of the element X is excessively small, it is hard to obtain the magnetic alloy in the amorphous state. Therefore, the contained amount of the element X is preferably determined to be in a range of 10 to 35 at %. The toroidal core 3 is preferably composed of a Co base amorphous alloy ribbon excelling in a saturable characteristic.

The amorphous alloy ribbon to be used as the magnetic alloy ribbon is preferably produced by applying a liquid quenching method. Specifically, the amorphous alloy ribbon is obtained by quenching an alloy material, which is adjusted to a predetermined composition ratio, from a molten state at a cooling speed of $10^{5°}$ C./sec. or higher. The amorphous alloy produced by the liquid quenching method becomes a ribbon. The amorphous alloy ribbon has a thickness of preferably 30 μm or below, and more preferably 8 to 20 μm. A low-loss magnetic core can be obtained by controlling the thickness of the magnetic alloy ribbon.

It is preferable that the Fe base magnetic alloy having a microcrystalline structure has a composition represented by the following formula (2):

$$\text{formula: } Fe_aCU_bM_cSi_dB_e \quad (2)$$

where, M denotes at least one element selected from a 4a group element, a 5a group element, a 6a group element, Mn, Ni, Co and Al of the periodic table, and $a+b+c+d+e=100$ at %, $0.01 \leqq b \leqq 4$ at %, $0.01 \leqq c \leqq 10$ at %, $10 \leqq d \leqq 25$ at %, $3 \leqq e \leqq 12$ at %, $17 \leqq d+e \leqq 30$ at %.

In the composition of the formula (2), Cu is an element effective to enhance corrosion resistance, to prevent the crystal grain from becoming coarse and to improve the soft magnetic characteristics such as an iron loss and magnetic permeability. The element M is an element effective for homogenization of a crystal diameter, for reduction of magnetostriction and magnetic anisotropy, and for improvement of the magnetic characteristics against a temperature shift. The Fe base magnetic alloy has a microstructure in which crystal grains having a grain diameter of 5 to 30 nm are contained in the alloy at an area ratio of 50% or more, and preferably 90% or more.

For example, the Fe base magnetic alloy ribbon having the microcrystalline structure is produced as follows. First, the amorphous alloy ribbon having the alloy composition of the formula (2) is produced by the liquid quenching method. The amorphous alloy ribbon is thermally treated at −50 to +120° C. of a crystallization temperature for one minute to five hours to precipitate microcrystals. Otherwise, when the alloy ribbon is produced by the liquid quenching method, the quenching temperature is controlled to precipitate the microcrystals directly. The Fe base magnetic alloy ribbon has a thickness of preferably 30 μm or below, and more preferably 8 to 20 μm, similar to the amorphous alloy ribbon.

The above-described magnetic alloy ribbon is wound to produce a wound body. Otherwise, the magnetic alloy ribbons are stacked to produce a stacked body. The winding number or the stacking number is appropriately determined depending on the required magnetic characteristics. If necessary, an insulating layer may be disposed on a surface of the magnetic alloy ribbon. The wound body is formed by winding the magnetic alloy ribbon to form a hollow section at its center. A magnetic core having the hollow section at the center, namely the toroidal core 3, can be obtained by winding the magnetic alloy ribbon.

The stacked body is formed by stacking the magnetic alloy ribbons with the hollow section formed at the center. For example, the magnetic alloy ribbon is cut to a predetermined length to produce short magnetic alloy strips, and a hole is formed in the centers of the short magnetic alloy strips. The magnetic core having a hollow section at the center is formed by stacking the short magnetic alloy strips. In other words, the toroidal core 3 can be obtained.

The toroidal core 3 is housed in the bottomed insulating resin case 4. The bottomed insulating resin case 4 includes a cylindrical outer wall section 6 and a cylindrical inner wall section 7 which is concentrically disposed within the cylindrical outer wall section 6. A bottom section 8 is disposed at one end of each of the cylindrical outer wall section 6 and the cylindrical inner wall section 7 to close a gap between them. In the stage of the bottomed insulating resin case 3 (indicated by the broken line in the drawing), an open section is provided at the other ends of the cylindrical outer wall section 6 and the cylindrical inner wall section 7. A hollow section 9 is provided within the cylindrical inner wall section 7. The toroidal core 3 is housed between the cylindrical outer wall section 6 and the cylindrical inner wall section 7.

In the stage of the bottomed insulating resin case 4, the cylindrical outer wall section 6 and the cylindrical inner wall section 7 have an extending section. The insulating resin case 4 of the first embodiment (FIG. 1) has an extending section 6*a* of the cylindrical outer wall section 6. The insulating resin case 4 of the second embodiment (FIG. 2) has the extending section 6*a* of the cylindrical outer wall section 6 and an extending section 7*a* of the cylindrical inner wall section 7. The extending sections 6*a* and 7*a* are sections extended upward over the height of the toroidal core 3 housed in the insulating resin case 4. The extending sections 6*a* and 7*a* configure the cover portion 5 through a bending process described later.

As an insulating resin forming the bottomed insulating resin case 4, there are, for example, PBT (polybutylene terephthalate), PET (polyethylene terephthalate), LCP (liquid crystal polymer), etc. To form the cover portion 5 by bending the extending sections 6*a* and 7*a* of the cylindrical outer wall section 6 and the cylindrical inner wall section 7, it is preferable to apply a method of bending with a heated metal head or the like pushed against the extending sections 6*a* and 7*a*. Thus, the mass productivity of the inductance elements 1 and 2 can be improved. Therefore, the insulating resin case 4 preferably has a characteristic that it can be bent without suffering from a crack or the like at a prescribed temperature.

The bottomed insulating resin case 4 is preferably made of a thermoplastic resin. All of PBT, PET and LCP are thermoplastic resins and preferable materials as a constituent material for the insulating resin case 4. The material for the insulating resin case 4 is also required to have a strength as the case. The insulating resin case 4 is preferably made of PBT in view of thermal deformability (bending workability), viscosity at that time, and strength characteristics as the case. Especially, PBT containing carbon has excellent spreadability, so that the strength of the insulating resin case 4 can be enhanced.

Thickness t of the bottomed insulating resin case 4 is not particularly limited, but it is preferably in a range of 0.1 to 0.5 mm in view of workability and strength. If the thickness is less than 0.1 mm, the strength of the insulating resin case 4 is reduced, the resin becomes poor to spread at the time of molding by metal molds, and it is necessary to mold under a high temperature. If the thickness of the insulating resin case 4 exceeds 0.5 mm, the strength is increased but the volume becomes larger more than necessary, and the insulating resin case 4 cannot be made small. In such a case, there might occur a situation that the inductance elements 1 and 2 cannot be inserted on the leads of the semiconductor element or the like. As to the thickness of the insulating resin case 4, it is preferable that all of the cylindrical outer wall section 6, the cylindrical inner wall section 7 and the bottom section 8 have a thickness in a range of 0.1 to 0.5 mm and uniformity.

The inductance element 1 according to the first embodiment has a bent section 10 which is formed by bending the extending section 6*a* of the cylindrical outer wall section 6 toward the cylindrical inner wall section 7 as shown in FIG. 1. The bent section 10 forms the cover portion 5 and serves a role of substantially a lid for the insulating resin case 4. Therefore, there occurs no problem that the toroidal core 3 comes out of the insulating resin case 4. Since fixing with an adhesive is not necessary, weight reduction can be made, and the adhesive does not defectively stick out. Since the manufacturing process can be simplified, the lead time can also be reduced.

In the inductance element 1 of the first embodiment, the bent section 10 is formed to cover the open section of the insulating resin case 4. The bent section 10 is preferably formed to overlap the cylindrical inner wall section 7. The tip end of the bent section 10 is preferably positioned above the cylindrical inner wall section 7. The tip end of the bent section 10 may be positioned inside the cylindrical inner wall section 7. In addition, the bent section 10 is not necessarily contacted to the cylindrical inner wall section 7. But, the bent section 10 is preferably formed such that the tip end part of the bent section 10 or its periphery portion comes into contact with the cylindrical inner wall section 7 in view of protectability of the toroidal core 3 housed in the insulating resin case 4.

The inductance element 2 according to the second embodiment has a first bent section 10 which is formed by bending the extending section 6*a* of the cylindrical outer wall section 6 toward the cylindrical inner wall section 7 and a second bent section 11 which is formed by bending the extending section 7*a* of the cylindrical inner wall section 7 toward the cylindrical outer wall section 6 as shown in FIG. 2. The first and second bent sections 10 and 11 are formed to cover the open section of the insulating resin case 4 and serve substantially as a lid (cover portion 5) of the insulating resin case 4. The cover portion 5 has the first and second bent sections 10 and 11. Therefore, there occurs no problem such as drop out of the toroidal core 3 from the insulating resin case 4.

Figure 3:
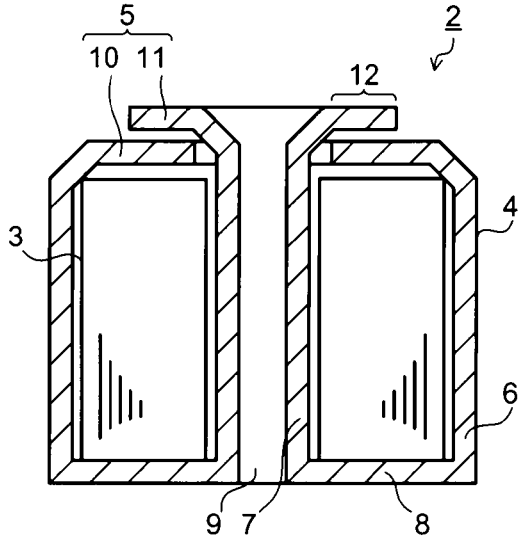
FIG. 3 is a sectional view showing a modified example of the inductance element shown in FIG. 2.

The inductance element 2 shown in FIG. 2 has the cover portion 5 which is formed by bending the extending section 6*a* of the cylindrical outer wall section 6 and the extending section 7*a* of the cylindrical inner wall section 7 such that the first bent section 10 is positioned above the second bent section 11 (outside of the second bent section 11). The structure of the cover portion 5 is not limited to the above. As shown in FIG. 3, the cover portion 5 may be formed by bending the extending section 6*a* of the cylindrical outer wall section 6 and the extending section 7*a* of the cylindrical inner wall section 7 such that the second bent section 11 is positioned above (outside of the first bent section 10) the first bent section 10.

In the inductance element 2 of the second embodiment, it is preferable that the first bent section 10 and the second bent section 11 are intersected. The inductance element 2 has an intersection 12 which is formed by intersecting the first bent section 10 and the second bent section 11. Formation of the intersection 12 eliminates the generation of a gap, so that the function of the cover portion 5 is improved. Therefore, the occurrence of a trouble such as dropout of the toroidal core 3 can be prevented more securely.

The intersection 12 is preferably configured by positioning the first bent section 10 above (outside) the second bent section 11 as shown in FIG. 2. When the first bent section 10 is positioned outside, the cover portion 5 can be suppressed from being broken, and insulating properties can be improved. When the second bent section 11 is positioned above (outside), stress generated when bending while expanding the diameter of the extending section 7*a* of the cylindrical inner wall section 7 is increased, and a breakage is liable to occur.

It is preferably that a gap C between the first bent section 10 and the second bent section 11 at the intersection 12 is 0.2 mm or below. If the gap C at the intersection 12 exceeds 0.2 mm, the effect of forming the intersection 12 might not be obtained satisfactorily. The first bent section 10 and the second bent section 11 may be directly contacted to each other at the intersection 12. The range of the gap C at the intersection 12 includes 0 mm. The gap C at the intersection 12 is determined to be a size (length) of the gap between the first bent section 10 and the second bent section 11 when they are closest to each other when the cross section of the element is observed.

It is preferable that the first bent section 10 and the second bent section 11 are in a non-adhered state at the intersection 12. Formation of the intersection 12 eliminates the need for bonding with an adhesive. It is more preferable that the gap C at the intersection 12 is in a range of 0.05 to 0.15 mm. By forming a small gap C at the intersection 12, a stress to the toroidal core 3 at the time of lead insertion can be reduced. Thus, the core can be suppressed from being broken at the time of lead insertion.

Since the thermally treated amorphous alloy ribbon or microcrystalline alloy ribbon is embrittled, the toroidal core 3 which is made of such an alloy ribbon is liable to break. Even in such a case, the core is suppressed from being broken by providing a small gap C at the intersection 12. Besides, it becomes easy to release heat generated from the toroidal core 3 when the inductance element 2 is used. In the inductance element 1 shown in FIG. 1, the gap between the bent section 10 and the cylindrical inner wall section 7 is determined as the gap of the intersection.

A width W of the intersection 12 is preferably ½ or below of a radius (½D) of the inductance element 2. The width W of the intersection 12 exceeds 0 mm. Even when the width W of the intersection 12 is made larger than ½ of the radius of the inductance element 2, the function of the cover portion 5 cannot be enhanced any more, but it becomes a cause of conversely inhibiting weight reduction. By observing a cross section of the element, the width W of the intersection 12 is determined to be a maximum width of the portion where the first bent section 10 and the second bent section 11 are overlapped mutually.

The diameter of the insulating resin case 4 is equal to a diameter D of the inductance element 2. The diameter D of the insulating resin case 4 is preferably in a range of 2 to 5 mm. The diameter of the hollow section 9 of the insulating resin case 4 is sufficient when the lead can be inserted, and it is preferably in a range of 1 to 3 mm practically. The height of the insulating resin case 4 is set depending on the height of the toroidal core 3. The extending sections 6*a* and 7*a* of the cylindrical outer wall section 6 and the cylindrical inner wall section 7 are determined to have a length depending on the diameter and inner diameter of the toroidal core 3. It is preferable that the extending sections 6*a* and 7*a* have a length such that the intersection 12 is formed, and the bent sections 10 and 11 have a width in a range of 2 to 5 mm.

In the inductance elements 1 and 2 of the embodiments, the open section of the bottomed insulating resin case 4 in which the toroidal core 3 is housed is covered by the cover portion 5 which is formed by bending the extending sections 6*a* and 7*a* of the cylindrical outer wall section 6 and the cylindrical inner wall section 7. Therefore, it is not necessary to provide a lid independent of the bottomed insulating resin case 4. And, metal molds for the lid are unnecessary. A process of attaching the lid and a labor of sealing the open section with an adhesive or the like are also unnecessary. Thus, the manufacturing process of the inductance elements 1 and 2 can be simplified, and the mass productivity can be improved. In addition, the production cost and equipment cost of the inductance elements 1 and 2 can be reduced.

Figure 4:
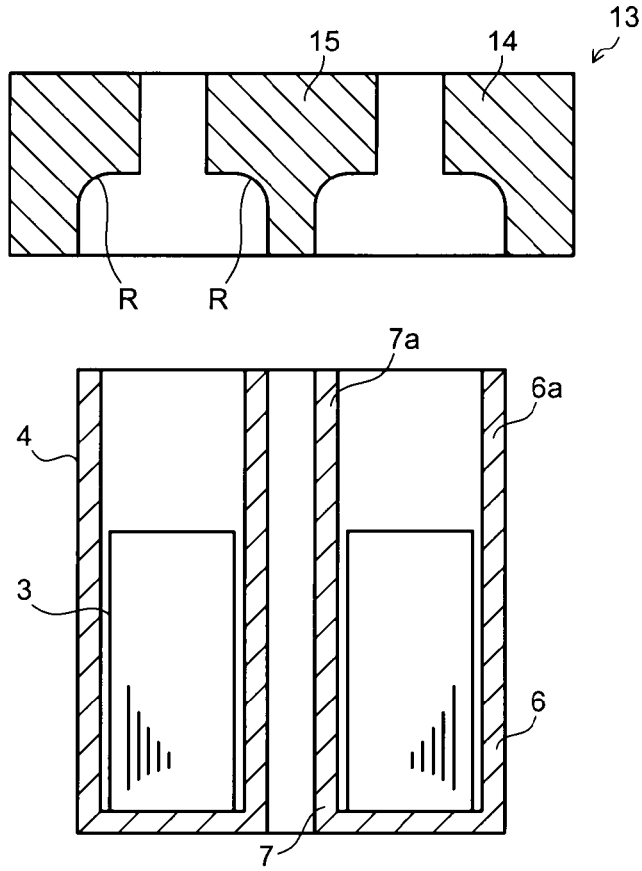
FIG. 4 is a sectional view showing a manufacturing process of the inductance element according to the second embodiment.

For example, the inductance elements 1 and 2 of the embodiments described above are produced as follows. A method of producing the inductance elements of the embodiments is described below with reference to FIG. 4. FIG. 4 shows a manufacturing process of the inductance element 2 shown in FIG. 2. First, the bottomed insulating resin case 4 having the extending section 6*a* of the cylindrical outer wall section and the extending section 7*a* of the cylindrical inner wall section 7 is prepared. The inductance element 1 shown in FIG. 1 can be produced by the same procedure except that the bottomed insulating resin case 4 having only the extending section 6*a* of the cylindrical outer wall section is used.

As shown in FIG. 4, the toroidal core 3 is housed in the insulating resin case 4. Then, a heated metal head 13 is pushed against the extending section 6*a* of the cylindrical outer wall section 6 and the extending section 7*a* of the cylindrical inner wall section 7 to bend the extending section 6*a* of the cylindrical outer wall section 6 toward the cylindrical inner wall section 7 to form the first bent section 10 and also to bend the extending section 7*a* of the cylindrical inner wall section 7 toward the cylindrical outer wall section 6 to form the second bent section 11. Thus, the open section of the insulating resin case 4 is covered by the cover portion 5 having the first bent section 10 and the second bent section 11.

When the heated metal head 13 is used, the extending sections 6*a* and 7*a* of the cylindrical outer wall section 6 and the cylindrical inner wall section 7 can be bent well. It is preferable that the metal head 13 is heated to a temperature in a range of not less than a temperature (Mp−0.2 Mp=0.8 Mp (° C.)) 20% lower than the melting point (Mp (° C.)) of the resin forming the insulating resin case 4 and not more than the melting point (Mp (° C.)). It is preferable that the heating temperature of the metal head 13 is not less than a temperature (0.85 Mp (° C.)) 15% lower than the melting point (Mp (° C.)) of the resin and not more than a temperature (0.95 Mp (° C.)) 5% lower than the melting point (Mp (° C.)). It is preferable that the specific heating temperature is variable depending on the constituent material of the insulating resin case 4, but in a range of 100 to 300° C., and more preferably in a range of 160 to 240° C.

When the heating temperature of the metal head 13 is less than 0.8 Mp (° C.), the extending sections 6*a* and 7*a* of the cylindrical outer wall section 6 and the cylindrical inner wall section 7 cannot be bent well. If the heating temperature of the metal head 13 exceeds the Mp (° C.), the insulating resin case 4 is altered, possibly resulting in melting. In such a case, the bent sections 10 and 11 cannot keep their shapes, the toroidal core 3 is exposed, and the function as an insulating outer package is impaired. If the temperature of the metal head 13 is excessively high, the toroidal core 3 might be adversely affected. For example, when an amorphous alloy ribbon is used as a constituent material for the toroidal core, characteristics of a coercive force and a squareness ratio might be deteriorated by heat.

The metal head 13 has a first head 14 for bending the extending section 6*a* of the cylindrical outer wall section 6 and a second head 15 for bending the extending section 7*a* of the cylindrical inner wall section 7. To push the metal head 13, the first bent section 10 can be positioned above (outside) the second bent section 11 by pushing the first head 14 after the second head 15 is pushed. Conversely, the second bent section 11 can be positioned above (outside) the first bent section 10 by pushing the second head 15 after the first head 14 is pushed.

Figure 5A:
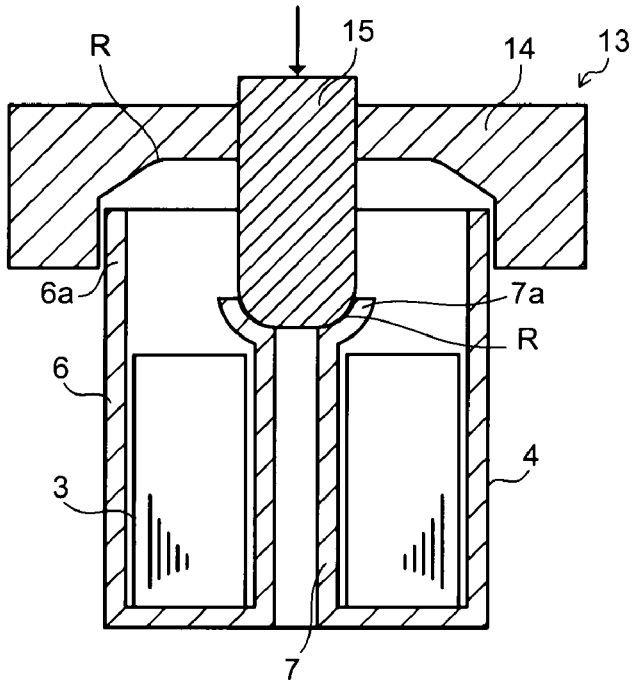
FIG. 5A to FIG. 5B are sectional views showing another manufacturing process of the inductance element according to the second embodiment.
Figure 5B:
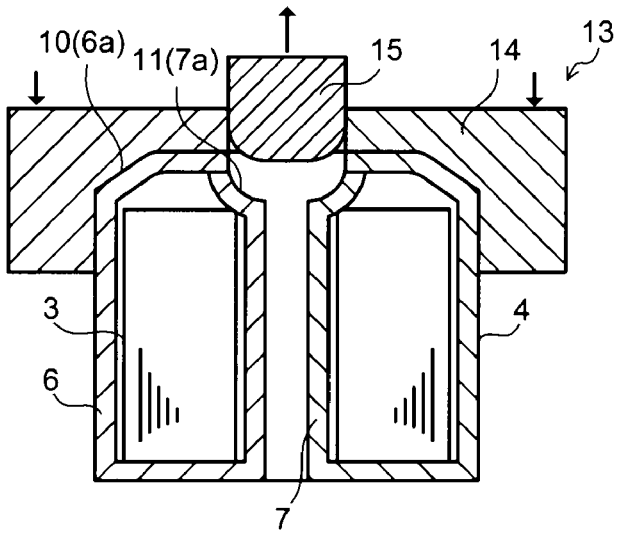

FIG. 5A and FIG. 5B show the operation of the first and second heads 14 and 15. As shown in FIG. 5A, the second head 15 is first lowered to bend the extending section 7*a* of the cylindrical inner wall section 7. The first head 14 may be lowered when the second head 15 is lowered to push first the second head 15 against the extending section 7*a* according to the head shape. Then, the first head 14 is lowered to bend the extending section 6*a* of the cylindrical outer wall section 6 as shown in FIG. 5B.

At this time, it is preferable that the second head 15 is pushed against the extending section 7*a* of the cylindrical inner wall section 7 until the bending process of the extending section 6*a* of the cylindrical outer wall section 6 is performed by the first head 14. The same procedure is also applied when the bending process of the extending section 6*a* of the cylindrical outer wall section 6 is performed first. In such a case, the first head 14 is preferably pushed against the extending section 6*a* of the cylindrical outer wall section 6 until the bending process by the second head 15 is performed.

After the extending sections 6*a* and 7*a* of the cylindrical outer wall section 6 and the cylindrical inner wall section 7 are processed, the first and second heads 14 and 15 are raised. At this time, it is preferable that the second head 15 is raised first regardless of the processing sequence of the cylindrical outer wall section 6 and the cylindrical inner wall section 7. When the second head 15 is raised later, the second head 15 adheres to the extending section 7*a*, possibly resulting in occurrence of a defect. The production yield of an inductance element can be improved by holding the insulating resin case 4 by the first head 14 until the second head 15 is raised.

As shown in FIG. 5A and FIG. 5B, it is preferable that the extending section 6*a* of the cylindrical outer wall section 6 is bent after the extending section 7*a* of the cylindrical inner wall section 7 is bent. In this case, the first bent section 10 is positioned on the top (outside) of the second bent section 11. The extending section 7*a* of the cylindrical inner wall section 7 is bent while its diameter is being expanded. The extending section 6*a* of the cylindrical outer wall section 6 is bent while its diameter is being decreased. When the second bent section 11 is bent later, the extending section 7*a* is bent while its diameter is being expanded more largely, so that a stress generated when bending is increased, and a breakage is liable to occur.

In the first and second heads 14 and 15 of the metal head 13, portions which are contacted to the extending sections 6*a* and 7*a* of the cylindrical outer wall section 6 and the cylindrical inner wall section 7 are round chamfered. By using the metal head 13, the workability of the extending sections 6*a* and 7*a* can be improved. It is preferable that the round surface has a curvature radius R in a range of 0.2 to 0.5 mm. If the round surface has an excessively small curvature radius (too close to a right angle), the extending sections 6*a* and 7*a* cannot be bent smoothly. If the round surface has an excessively large curvature radius, the extending sections 6*a* and 7*a* cannot be bent. It is preferable that a ratio (t/R) of the curvature radius R of the round surface of the metal head 13 and a thickness t of the insulating resin case 4 is in a range of 0.5 to 1.5.

Figure 6:
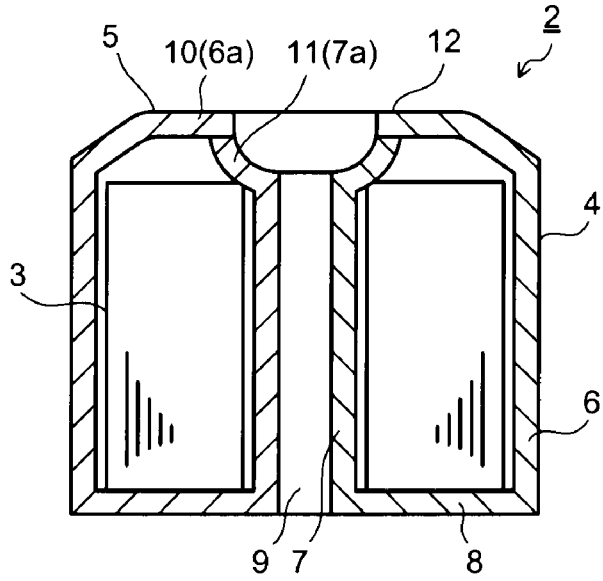
FIG. 6 is a sectional view showing a modified example of a structure of a cover portion of the inductance element according to the embodiment.

FIG. 6 shows the inductance element 2 manufactured by applying the manufacturing process shown in FIG. 5A and FIG. 5B. The extending section 7*a* of the cylindrical inner wall section 7 is bent into a shape with the tip end of the second bent section 11 directed upward according to the shape of the second head 15. The first bent section 10 which is formed by bending the extending section 6*a* of the cylindrical outer wall section 6 is in contact with the upward tip end of the second bent section 11. In this case, the first bent section 10 and the second bent section 11 are intersected. For the intersection 12, various shapes can be applied depending on the shape, processing conditions and the like of the metal head 13.

Figure 7:
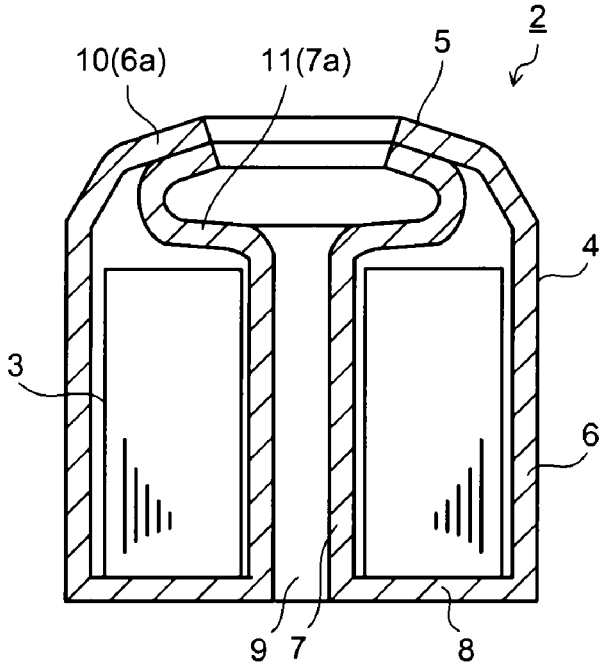
FIG. 7 is a sectional view showing another modified example of the structure of a cover portion of the inductance element according to the embodiment.
Figure 8:
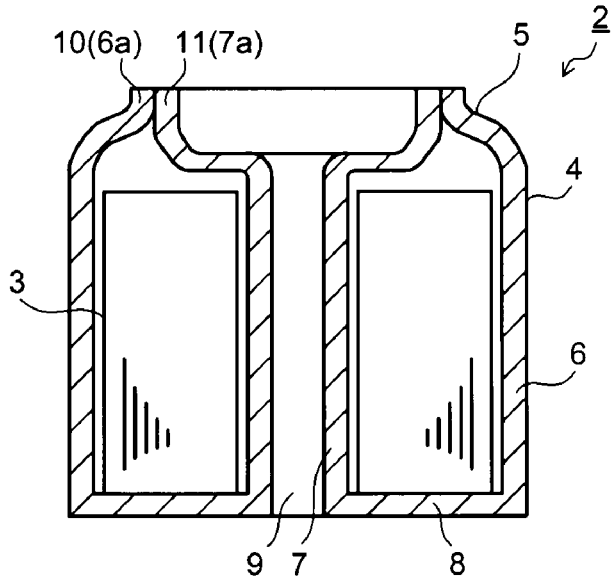
FIG. 8 is a sectional view showing another modified example of the structure of the cover portion of the inductance element according to the embodiment.

FIG. 7 and FIG. 8 show other structures of the cover portion 5. In the inductance element 2 shown in FIG. 7, the extending section 7*a* of the cylindrical inner wall section 7 is bent to direct inward the tip end of the second bent section 11. The first bent section 10 is contacted to the outer surface of the second bent section 11 which is directed inward. In the inductance element 2 shown in FIG. 8, the first bent section 10 and the second bent section 11 are contacted with their inner surfaces of the tip end portions. For the cover portion 5, various structures that the first bent section 10 and the second bent section 11 are mutually contacted can be adopted.

The heated metal head 13 can be used for mechanization of the forming process of the bent sections 10 and 11. The mass productivity of the inductance elements 1 and 2 can be improved by provision of plural or multistage metal heads 13. The width W and gap C of the intersection 12 can be adjusted by controlling the length of the extending sections 6*a* and 7*a* and the pushing time of the metal head 13. By controlling the moving distance of the metal head 13, the extending sections 6*a* and 7*a* can be bent at a position where the toroidal core 3 can be fixed within the insulating resin case 4 without applying an unnecessary stress to the toroidal core 3. As described above, the pushing time of the metal head 13 can be reduced by setting the thickness of the insulating resin case 4 to 0.5 mm or below.

Figure 9:
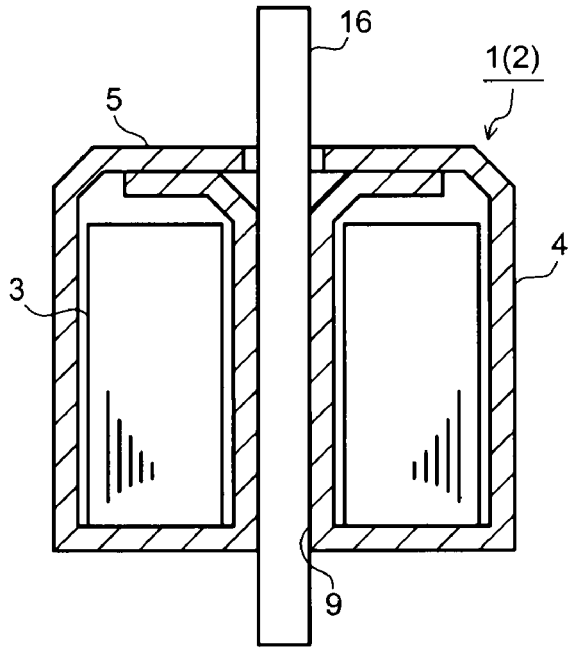
FIG. 9 is a sectional view showing a state that a conductive lead is inserted into a hollow section of the inductance element shown in FIG. 2.

The above-described inductance elements 1 and 2 are used with a conductive lead 16 inserted into the hollow section 9 as shown in FIG. 9. The conductive lead 16 is a lead of the semiconductor element such as a diode or a transistor. The inductance elements 1 and 2 are directly inserted on the lead 16 of the semiconductor element. The inductance elements 1 and 2 are used as noise suppression elements of the semiconductor element. The conductive lead 16 separately prepared may be inserted into the hollow section 9 of the inductance elements 1 and 2. In a case where the inductance elements 1 and 2 are mounted on a wiring board or the like, it is preferable to use the conductive lead 16 having a square U-shaped form or a U-shaped form.

FIG. 9 shows the inductance element that the inner diameter of the hollow section 9 and the width of the lead 16 are substantially the same. The hollow section 9 and the lead 16 may have a gap between them. Even if there is no gap and the lead 16 has a large width, the lead 16 can be inserted by virtue of the elasticity of the insulating resin case 4. In such a case, the mount stability of the inductance elements 1 and 2 can be improved. It is preferable that the difference between the inner diameter of the hollow section 9 and the width of the lead 16 is 0.15 mm or below. If it is larger, the insulating resin case 4 or the toroidal core 3 might be damaged.

The inductance elements 1 and 2 may be used with a winding applied instead of the lead 16. The winding wound around the inductance elements 1 and 2 is connected to wiring, so that the inductance elements 1 and 2 are used as the noise suppression elements or the like. The inductance elements 1 and 2 exert an excellent noise reducing effect. And, the inductance elements 1 and 2 are suitably used as a noise suppression element for the electronic equipment such as a switching power supply. The switching power supply is being used in various electronic equipments such as PC, a server and the like. The performance of the electronic equipment can be improved by the noise reduction.

Figure 10:
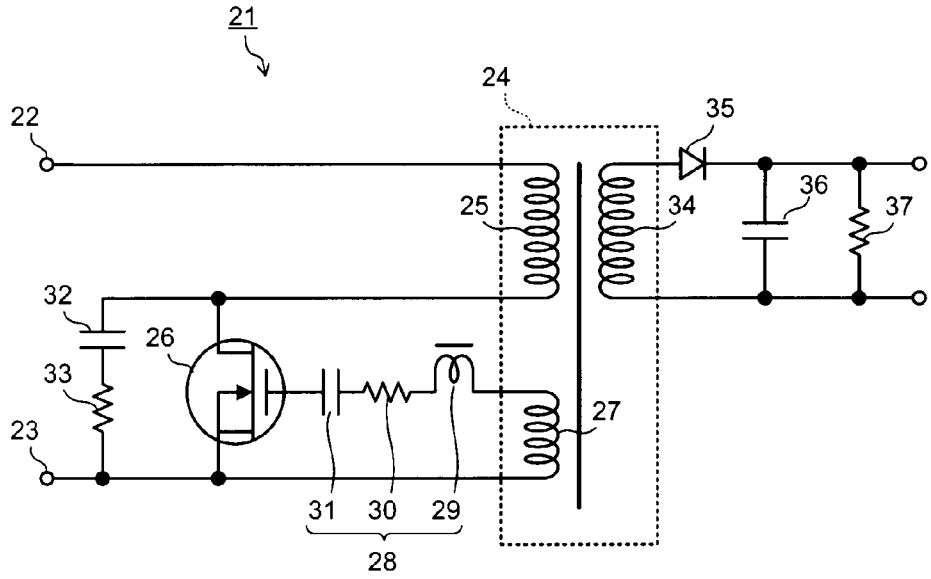
FIG. 10 is a diagram showing a structure of a switching power supply according to a first embodiment.

FIG. 10 is a circuit diagram showing a structure of a switching power supply according to a first embodiment. A self-excited fly-back type switching power supply 21 shown in FIG. 10 has a primary winding 25 of a transformer 24 connected in series between input terminals 22 and 23 and FET (MOSFET) 26 as a switching element. The transformer 24 is further provided with a winding 27 for a gate circuit drive of the FET 26. In other words, the winding 27 is a positive feedback winding of the transformer 24 which is wound to make the self-oscillation of the FET 26.

A drive circuit 28 for sending the signal of the positive feedback winding 27 to the FET 26 is disposed between the gate terminal of the FET 26 and the positive feedback winding 27. The drive circuit 28 is configured by connecting in series an inductor 29, a resistor 30 and a capacitor 31, and functions as a snubber circuit. The resistor 30 gives an appropriate drive current to the FET 26, and the capacitor 31 improves the drive property of the FET 26. The inductor 29 has saturability and a function to delay the gate signal of the FET 26. The inductance elements 1 and 2 of the embodiment are applied to the saturable inductor 29 and function as the noise suppression elements of the FET 26.

A snubber capacitor 32 for absorbing a surge voltage which is generated in the primary winding 25 of the transformer 24 is connected in series between the primary winding 25 of the transformer 24 and the input terminal 23. The snubber capacitor 32 is connected parallel to the FET 26. In addition, a snubber resistor 33 is connected in series to the snubber capacitor 32. A rectifying element 35 and a capacitor 36 are connected as a rectifying/smoothing circuit to a secondary winding 34 of the transformer 24. A resistor 37 is a load.

Figure 11:
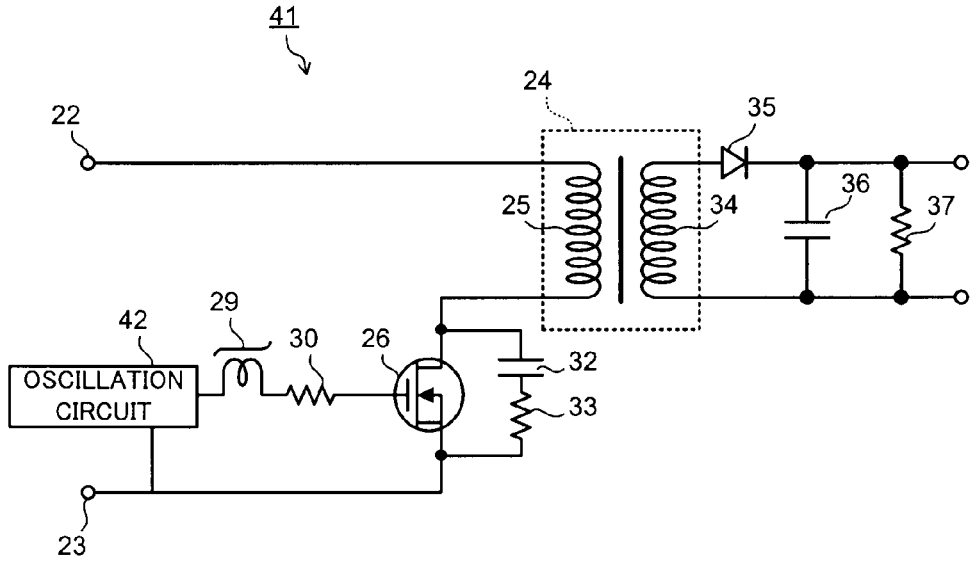
FIG. 11 is a diagram showing a structure of a switching power supply according to a second embodiment.

FIG. 11 is a circuit diagram showing a structure of a switching power supply according to a second embodiment. A separately-excited fly-back type switching power supply 41 shown in FIG. 11 is provided with an oscillation circuit 42 as a drive circuit of the FET 26. A saturable inductor 29 and a resistor 30 are connected in series between the FET 26 and the oscillation circuit 42. The saturable inductor 29 functions as the noise suppression element of the FET 26 similar to the first embodiment, and the inductance elements 1 and 2 of the embodiment are applied.

Figure 12:
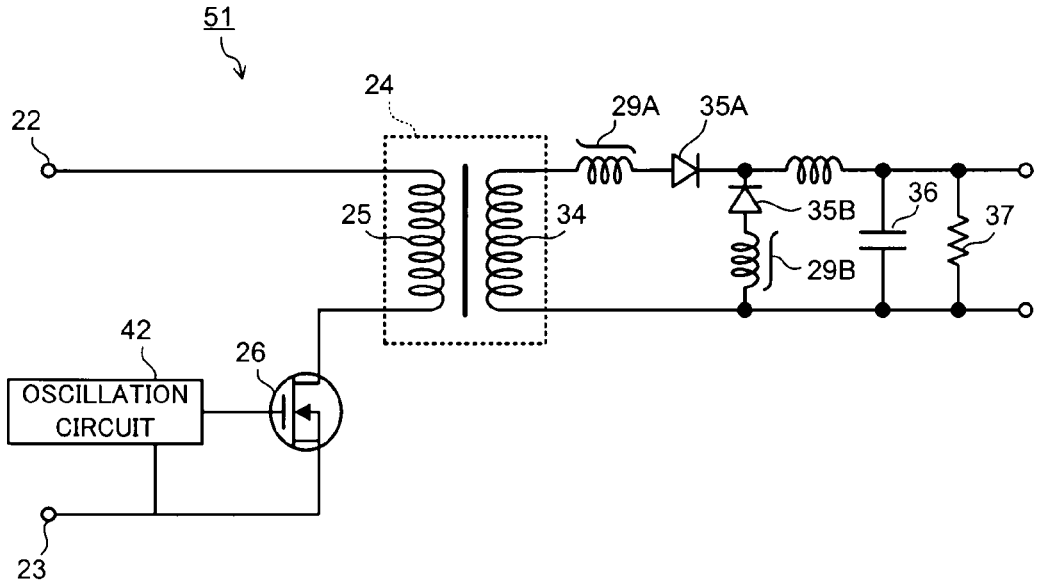
FIG. 12 is a diagram showing a structure of a switching power supply according to a third embodiment.

FIG. 12 is a circuit diagram showing a structure of a switching power supply according to a third embodiment of the invention. A forward converter type switching power supply 51 shown in FIG. 12 is provided with the oscillation circuit 42 as the drive circuit of the FET 26. Rectifying elements 35A and 35B which are disposed on a secondary side of the transformer 24 are connected with saturable inductors 29A and 29B respectively. The saturable inductors 29A and 29B function as the noise suppression elements for the rectifying elements 35A and 35B, and the inductance elements 1 and 2 of the embodiment are applied for that.

Specific examples of the present invention and the evaluated results are described below.

EXAMPLES 1 TO 6 AND COMPARATIVE EXAMPLES 1 TO 2

A Co base amorphous magnetic alloy ribbon (average thickness of 18 μm) having a composition of $(Co_{0.94}Fe_{0.05}Cr_{0.01})_{72}Si_{15}B_{13}$ was wound to form a toroidal core. An insulation coating was previously formed on a surface of the amorphous magnetic alloy ribbon. The toroidal core was determined to have an outer diameter of 3 mm, an inner diameter of 2 mm and a height of 3 mm.

The toroidal core was housed in a bottomed insulating resin case (outermost diameter 4 mm, innermost diameter 1.5 mm, highest height 6.2 mm, thickness 0.3 mm). The insulating resin case was produced from a PBT resin (manufactured by WinTech Polymer Ltd., 2016 (trade name), melting point of 220° C.). The PBT resin contains a small amount of carbon and has a black color. Then, the extending sections of the cylindrical outer wall section and the cylindrical inner wall section were bent by the apparatus shown in FIG. 4 to produce the inductance element. A bending process was performed by using a heated SUS metal head (heating temperature of 200° C.).

Example 1 is an inductance element (FIG. 1) obtained by bending the extending section of the cylindrical outer wall section. Example 2 is an inductance element (FIG. 3) obtained by bending so that the extending section of the cylindrical inner wall section comes to the top (outside) of the extending section of the cylindrical outer wall section. Example 3 is an inductance element (FIG. 2) obtained by bending so that the extending section of the cylindrical outer wall section comes to the top (outside) of the extending section of the cylindrical inner wall section. In Example 2 and Example 3, it was determined that the first bent section (outer wall section) and the second bent section (inner wall section) have a gap of 0 mm (contacted state), and the intersection has a width of 0.8 mm.

Example 4 is an inductance element with the gap between the bent section and the inner wall section of Example 1 changed to 0.4 mm. Example 5 is an inductance element with the gap between the bent section and the inner wall section of Example 1 changed to 0.8 mm. Example 6 is an inductance element having the shape shown in FIG. 6. Comparative Example 1 was obtained by fitting a doughnut-shaped lid (thickness of 0.5 mm) into an open section of the insulating resin case (without thermal processing) of Example 1 and fixing the lid by bending the extending section of the cylindrical outer wall section. Comparative Example 2 was obtained by sealing the open section of the insulating resin case (without thermal processing) of Example 1 by an adhesive (manufactured by Sanyu Rec Co., Ltd., EX-664/H-390 (two liquid curing type)).

The inductance elements of Examples 1 to 6 and Comparative Examples 1 and 2 were measured for each process lead time, inductance value (average of five samples) and appearance yield. The lead time is a duration from a time when the core is housed in the insulating resin case to a time when the opening is sealed by an insulator and indicated as a relative value with the lead time of the Comparative Example 1 determined as 1. Comparative Example 2 includes a time for drying the adhesive. The appearance yield denotes a ratio (non-defective rate) of the elements which did not deform or expose a metal (toroidal core) after performing the vibration test (10 to 55 Hz reciprocation for one minute, 1.55 mmp-p, each of XYZ directions for two hours) of 20 samples.

TABLE 1

| | Lead time | Inductance [μH] | Gap C [mm] | Appearance yield [%] |
|---|---|---|---|---|
| Example 1 | 0.3 | 5.1 | 0.18 | 100 |
| Example 2 | 0.5 | 5.1 | 0 | 100 |
| Example 3 | 0.5 | 5.1 | 0 | 100 |
| Example 4 | 0.3 | 5.1 | 0.4 | 90 |
| Example 5 | 0.3 | 5.1 | 0.8 | 85 |
| Example 6 | 0.4 | 5.1 | 0 | 100 |
| Comp. Exam. 1 | 1 | 5.1 | 0 | 100 |
| Comp. Exam. 2 | 7 | 4.6 | 0 | 100 |

It is seen from Table 1 that Examples 1 to 6 have a short lead time, maintain inductance performance and have excellent appearance. If a gap exceeds 0.2 mm as in Example 4 and Example 5, the metal protrudes into a conical shape depending on the toroidal core, and the metal piece is exposed, so that there is a possibility that an electric problem (short circuit etc.) occurs when mounting on the substrate. Even if there is a gap as in Example 1, there is not any problem if it is 0.2 mm or below.

Since Examples 2 and 3 have the intersection, they are advantageous in view of the intersection, but the lead time is longer than in Example 1 because it is necessary to bend the outer wall section and the inner wall section. But, when the shape of the metal head is changed (from two heads to one head), it is also possible to do with single heating. It is preferable that the metal head shape has a round surface on the portions contacted to the extending section as shown in FIG. 4. The inductance element is also provided with the same R shape. Comparative Example 2 had a long lead time because it takes time to dry the adhesive, and the inductance was lowered because of curing of the adhesive.

EXAMPLES 7 TO 12

When the inductance element of Example 2 or Example 3 is produced, the width W of the intersection between the first bent section (outer wall section) and the second bent section (inner wall section) and the gap C between first bent section and the second bent section were adjusted as shown in Table 2 by controlling the case shape (length of the extending sections of the cylindrical outer wall section and the cylindrical inner wall section), pushing time of the metal head and the like. The produced inductance element was measured by the same procedure as in Example 1. The lead time is indicated as the relative value with the lead time of Comparative Example 1 determined as a standard (1) similar to Example 2.

TABLE 2

| | Basic structure | Lead time | Inductance [μH] | Width W of intersection [mm] | Gap C [mm] | Appearance yield [%] |
|---|---|---|---|---|---|---|
| Example 7 | Example 3 | 0.5 | 5.1 | 0 | 0.2 | 100 |
| Example 8 | Example 3 | 0.5 | 5.1 | 0.05 | 1.3 | 100 |
| Example 9 | Example 3 | 0.5 | 5.1 | 0.4 | 0.5 | 100 |
| Example 10 | Example 2 | 0.5 | 5.1 | 0 | 0.1 | 100 |
| Example 11 | Example 2 | 0.5 | 5.1 | 0.2 | 0.15 | 100 |
| Example 12 | Example 2 | 0.5 | 5.1 | 0.4 | 0 | 96 |

As shown in Table 2, the appearance yield of the inductance element can be improved by adjusting the width W of the intersection and the gap C of the intersection.

EXAMPLES 13 TO 16

The inductance elements of Example 1 and Example 3 with the thicknesses of the bottomed insulating resin cases changed to those shown in Table 3 were prepared. The inductance elements were produced in the same manner as in Example 1 and Example 3 except that the above insulating resin cases were used. The obtained inductance elements were measured in the same manner as in Example 1.

TABLE 3

| | Basic structure | Case thickness [mm] | Lead time | Inductance [μH] | Appearance yield [%] |
|---|---|---|---|---|---|
| Example 13 | Example 1 | 1 | 0.5 | 5.1 | 100 |
| Example 14 | Example 3 | 0.5 | 0.5 | 5.1 | 100 |
| Example 15 | Example 3 | 0.1 | 0.4 | 5.1 | 100 |
| Example 16 | Example 3 | 0.08 | 0.3 | 5.1 | 60 |

It is seen from Table 3 that the lead time becomes long if the insulating resin case is excessively thick. Meanwhile, if it is excessively thin, the appearance yield decreases. The appearance yield shown in Table 3 also includes the yield at the time of molding the case. Especially, when the insulating resin case has a small thickness of 0.08 mm, there occurred lots of defective appearances such as a hole and a crack. It is preferable in view of the above that the insulating resin case is determined to have a thickness in a range of 0.1 to 0.5 mm.

Then, the lead was inserted into the individual inductance elements. The lead used is a lead of a TO-220 size diode and of a 1.5×0.5 mm square (diagonal line 1.58 mm). This lead has a diagonal dimension which is 0.08 mm larger than a diameter of 1.5 mm of the hollow section (innermost diameter of the case) and is closer to a state that the lead is press fitted into the hollow section while expanding the hollow section by it. After the lead is inserted, the case appearance and the inductance value were measured.

TABLE 4

| | Basic structure | Case thickness [mm] | Inductance [μH] | Insertion rate [%] | Appearance yield [%] |
|---|---|---|---|---|---|
| Example 13 | Example 1 | 1 | 3.1 | 100 | 50 |
| Example 14 | Example 3 | 0.5 | 5.1 | 100 | 100 |
| Example 15 | Example 3 | 0.1 | 5.1 | 100 | 100 |
| Example 16 | Example 3 | 0.08 | 5.1 | 100 | 10 |

It is seen from Table 4 that the lead can be inserted when the insulating resin case has a large thickness of 1 mm, but the elasticity of the case does not have an allowance, and defective appearance was caused because the case was damaged by the lead. When the insulating resin cases were excessively thin, most of them were cracked while the lead was being inserted. In view of the above, it is preferable that the insulating resin case has a thickness in a range of 0.1 to 0.5 mm.

EXAMPLES 17 TO 25 AND REFERENCE EXAMPLE 1

Same toroidal cores as those of Example 2 and Example 3 were prepared. The inductance elements of Example 2 and Example 3 with the individual dimensions (thickness, and length of extending sections of outer wall section and inner wall section) of the bottomed insulating resin cases changed as shown in Table 5 were prepared. The length of the extending section is a length of a portion which exceeds the height of the core. Such insulating resin cases were used to produce the inductance elements according to the conditions shown in Table 6.

TABLE 5

| | Thickness [mm] | Length of extending portion of outer wall section [mm] | Length of extending portion of inner wall section [mm] |
|---|---|---|---|
| Case 1 | 0.3 | 1.23 | 1.13 |
| Case 2 | 0.3 | 1.13 | 1.23 |
| Case 3 | 0.1 | 1.23 | 1.13 |
| Case 4 | 0.5 | 1.23 | 1.13 |
| Case 5 | 1.0 | 1.23 | 1.13 |

When the inductance elements of Examples 17 to 25 were produced, their production yields were checked. It was determined to use 100 samples for each of Examples 17 to 25. The production yield was judged as a defect if the core is visible through the gap of the intersection, if the bending process is insufficient and the core metal piece adheres to or is stuck out at the gap or the intersection, if the case is considerably deformed and the core metal piece is stuck out within the hollow section or outside of the outer wall section or if the case is chipped or cracked.

TABLE 6

| | Case | Heating temp. of metal head [° C.] | Moving sequence of head | Round surface of head [mm] | Production yield [%] |
|---|---|---|---|---|---|
| Example 17 | Case 1 | 185 | Inside → Outside | 0.3 | 81 |
| Example 18 | Case 1 | 200 | Inside → Outside | 0.3 | 100 |
| Example 19 | Case 1 | 220 | Inside → Outside | 0.3 | 90 |
| Example 20 | Case 1 | 200 | Outside → Inside | 0.3 | 88 |
| Example 21 | Case 2 | 200 | Inside → Outside | 0.3 | 100 |
| Example 22 | Case 2 | 200 | Outside → Inside | 0.3 | 85 |
| Example 23 | Case 3 | 200 | Inside → Outside | 0.1 | 97 |
| Example 24 | Case 4 | 200 | Inside → Outside | 0.5 | 100 |
| Example 25 | Case 5 | 200 | Inside → Outside | 1.0 | 97 |
| Reference Example 1 | Case 1 | 150 | Inside → Outside | 0.3 | 0 (Does not bend) |

The production yield can be enhanced by controlling the production conditions of the inductance element. When the insulating resin case has a large thickness of 1 mm (Example 25), the yield decreases, and when the metal head has a low temperature (Reference Example 1), the resin forming the case did not bent. When the length of the extending section of the inner wall section is longer than that of the extending section of the outer wall section as in Example 20 and the extending section of the outer wall section is bent first, the yield was decreased little because an excess portion of the extending section protrudes toward the inner diameter side. The same tendency was also observed in Example 22.

As to the length of the extending sections of the outer wall section and the inner wall section, it is preferable that the length of the extending section to be bent first is determined to be shorter than that of the extending section to be bent later. In addition, when the length of the extending section of the inner wall section is longer than that of the extending section of the outer wall section independent of the production yield of the inductance element, an insertion failure of the toroidal core tends to occur. In view of this, it is preferable that the length of the extending section to be bent first is shorter than that of the extending section to be bent later.

EXAMPLES 26 TO 29

When the inductance elements are produced by applying the same production conditions as those of Example 18, the production yield was checked with the shape of the round surface of the metal head changed as shown in Table 7. The insulating resin case is the case 1 shown in Table 5 and its thickness is 0.3 mm.

TABLE 7

| | Round surface of metal head [mm] | Production yield [%] |
|---|---|---|
| Example 18 | 0.3 | 100 |
| Example 26 | 0.1 | 92 |
| Example 27 | 0.2 | 100 |
| Example 28 | 0.5 | 84 |
| Example 29 | 1 | 21 |

When the insulating resin case had a thickness of 0.3 mm and the curvature radius of the round surface was the same 0.3 mm as the thickness of the case, the production yield was best. The production yield decreases in Example 26 that the round surface is excessively small with respect to the thickness of the case and also in Example 29 that it is excessively large. It is also apparent from the results that the ratio (t/R) of the thickness t and the round surface of the case is preferably in a range of 0.5 to 1.5.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An inductance element, comprising:

a bottomed insulating resin case including a cylindrical outer wall section, a cylindrical inner wall section disposed within the cylindrical outer wall section, a bottom section disposed at one ends of the cylindrical outer wall section and the cylindrical inner wall section to close a space between the cylindrical outer wall section and the cylindrical inner wall section, an open section provided at the other ends of the cylindrical outer wall section and the cylindrical inner wall section, and a hollow section provided within the cylindrical inner wall section;

a toroidal core housed between the cylindrical outer wall section and the cylindrical inner wall section of the bottomed insulating resin case; and a cover portion including a bent section formed by bending an extending section of the cylindrical outer wall section exceeding a height of the toroidal core toward the cylindrical inner wall section to cover the open section of the bottomed insulating resin case.

2. The inductance element according to claim 1, wherein the bottomed insulating resin case has a thickness in a range of 0.1 mm or more and 0.5 mm or less.

3. The inductance element according to claim 1, wherein a conductive lead is inserted into the hollow section of the bottomed insulating resin case.

4. An inductance element, comprising:

a bottomed insulating resin case including a cylindrical outer wall section, a cylindrical inner wall section disposed within the cylindrical outer wall section, a bottom section disposed at one ends of the cylindrical outer wall section and the cylindrical inner wall section to close a space between the cylindrical outer wall section and the cylindrical inner wall section, an open section provided at the other ends of the cylindrical outer wall section and the cylindrical inner wall section, and a hollow section provided within the cylindrical inner wall section;

a toroidal core housed in an insulated state between the cylindrical outer wall section and the cylindrical inner wall section of the bottomed insulating resin case; and a cover portion including a first bent section, which is formed by bending an extending section of the cylindrical outer wall section exceeding a height of the toroidal core toward the cylindrical inner wall section, and a second bent section, which is formed by bending an extending section of the cylindrical inner wall section exceeding a height of the toroidal core toward the cylindrical outer wall section, to cover the open section of the bottomed insulating resin case.

5. The inductance element according to claim 4, wherein the cover portion has an intersection which is formed by intersecting the first bent section and the second bent section.

6. The inductance element according to claim 5, wherein the first bent section is positioned outside of the second bent section.

7. The inductance element according to claim 5, wherein the intersection has a gap of 0.2 mm or below (including zero).

8. The inductance element according to claim 5, wherein a width of the intersection is not more than ½ of the radius of the bottomed insulating resin case.

9. The inductance element according to claim 4, wherein the bottomed insulating resin case has a thickness in a range of 0.1 mm or more and 0.5 mm or less.

10. The inductance element according to claim 4, wherein the toroidal core has a wound body or a stacked body of a magnetic alloy ribbon.

11. The inductance element according to claim 4, wherein a conductive lead is inserted into the hollow section of the bottomed insulating resin case.

12. The inductance element according to claim 11, wherein the conductive lead is a lead of the semiconductor element.

13. A method for manufacturing an inductance element, comprising:

housing a toroidal core into a bottomed insulating resin case including a cylindrical outer wall section, a cylindrical inner wall section disposed within the cylindrical outer wall section, a bottom section disposed at one ends of the cylindrical outer wall section and the cylindrical inner wall section to close a space between the cylindrical outer wall section and the cylindrical inner wall section, an open section provided at the other ends of the cylindrical outer wall section and the cylindrical inner wall section, and a hollow section provided within the cylindrical inner wall section; and covering the open section of the bottomed insulating resin case by pushing a heated metal head against an extending section of the cylindrical outer wall section exceeding a height of the toroidal core to bend the extending section toward the cylindrical inner wall section.

14. A method for manufacturing an inductance element, comprising:

housing a toroidal core into a bottomed insulating resin case including with a cylindrical outer wall section, a cylindrical inner wall section disposed within the cylindrical outer wall section, a bottom section disposed at one ends of the cylindrical outer wall section and the cylindrical inner wall section to close a space between the cylindrical outer wall section and the cylindrical inner wall section, an open section provided at the other ends of the cylindrical outer wall section and the cylindrical inner wall section, and a hollow section provided within the cylindrical inner wall section; and covering the open section of the bottomed insulating resin case by pushing a heated metal head against an extending section of the cylindrical outer wall section exceeding a height of the toroidal core and against an extending section of the cylindrical inner wall section exceeding a height of the toroidal core to bend the extending section of the cylindrical outer wall section toward the cylindrical inner wall section and to bend the extending section of the cylindrical inner wall section toward the cylindrical outer wall section.

15. The manufacturing method according to claim 14, wherein the extending section of the cylindrical outer wall section is bent after the extending section of the cylindrical inner wall section is bent.

16. The manufacturing method according to claim 14, wherein the metal head is heated to a temperature in a range of 20% lower than the melting point of the resin forming the bottomed insulating resin case and not higher than the melting point.

17. The manufacturing method according to claim 14, wherein the metal head is provided with a round surface on a portion contacted to the extending section.

18. The manufacturing method according to claim 14, wherein the bottomed insulating resin case has a thickness in a range of 0.1 mm or more and 0.5 mm or less.

19. A switching power supply comprising the inductance element according to claim 1 as a noise suppression element.

20. A switching power supply comprising the inductance element according to claim 4 as a noise suppression element.

* * * * *